United States Patent [19]

Wiseman

[11] Patent Number: 4,543,767

[45] Date of Patent: Oct. 1, 1985

[54] CASE OPENING APPARATUS

[75] Inventor: John A. Wiseman, Lynchburg, Va.

[73] Assignee: Simplimatic Engineering Co., Lynchburg, Va.

[21] Appl. No.: 440,187

[22] Filed: Nov. 8, 1982

[51] Int. Cl.[4] ..... B65B 57/04; B65B 43/38

[52] U.S. Cl. ..... 53/76; 53/382

[58] Field of Search ..... 53/76, 381 R, 382, 468

[56] References Cited

U.S. PATENT DOCUMENTS

| | | | |
|---|---|---|---|
| 3,241,292 | 3/1966 | Berney | 53/382 |
| 4,160,351 | 7/1979 | Mais et al. | 53/382 |
| 4,191,005 | 3/1980 | Vinoskey | 53/382 |

*Primary Examiner*—Robert L. Spruill
*Assistant Examiner*—Richard M. Mudd
*Attorney, Agent, or Firm*—James & Franklin

[57] ABSTRACT

Movement of the case conveyor is terminated with the leading flap aligned with a flap engaging element mounted above the case on the end shaft. The shaft is rotated to cause the element to engage and partially open the leading flap. The shaft is supported by a carriage which is movable along a track extending in the direction of conveyor movement. As the element reaches its final rotational position, movement of the carriage along the track is initiated, causing the element to pivot the leading flap to the open position. Movement of the conveyor is then resumed as the carriage returns to its initial position. The rotational and translational movements of the element are independently actuatable and adjustable.

28 Claims, 6 Drawing Figures

CASE OPENING APPARATUS

The present invention relates to case opening apparatus and, more particularly, to such an apparatus including a mechanism for automatically opening the leading flap of a case, which is adapted for use with cases of a wide range of flap sizes.

Various forms of automatic case packing equipment are well known in the art. In general, automatic case packing equipment includes an in-feed conveyor which transports empty cases or cartons, usually composed of cardboard or the like, to a packing station, wherein bottles, jars, or similar items are placed in the case. The loaded case is transferred to a case closing mechanism which closes and seals the flaps of the case. The closed case is then moved along an out-feed conveyor to be palletized or removed individually for storage and/or shipping.

Since cases are normally stored, prior to loading, with the flaps closed but unsealed, it is necessary to open the case flaps prior to the packing operation. For use in conjunction with an automatic case packer, apparatus can be provided for automatically opening the flaps of the case prior to transfer of the case to the packing station. The case opening apparatus may be located on the in-feed conveyor of the case packing equipment or on a separate conveyor which feeds the in-feed conveyor.

A case or carton has four flaps, designated for convenience by the direction of case movement along the conveyor, as a leading flap, the trailing flap and a pair of side flaps. Because of the position of each type of flap and the direction in which the flaps must be moved in order to open same, separate mechanisms are normally provided to open each type of flap.

It is well known in the art to use a plow to open the side flaps and a hook-type device to open the trailing flap. However, the design of the mechanism for opening the leading flap presents special problems because the leading flap must be reliably engaged and thereafter moved in the same direction as case movement.

In order to perform the leading flap opening operation, a variety of mechanisms of different design have been utilized. Some of these mechanisms employ hook-type devices which, in timed relation with the case movement along the conveyor, are pivoted in an arc to engage and open the leading flap, as the case is moved. Other types utilize a helically movable flap engaging member, a pin affixed to a rotating chain, or the like. However, none of these conventional mechanisms operate satisfactorily, either because of difficulties with respect to the engagement of the flap as the case is moved with respect to the flap opening mechanism, or because the flap, once engaged, is not reliably moved to the proper open position. Further, these conventional mechanisms tend to be complex in nature, having a large number of moving parts, including apparatus to coordinate the timing of the flap opening device with case movement. Moreover, known leading flap opening mechanisms are normally relatively expensive to manufacture, require substantial maintenance, and take up a large amount of plant space.

A unique leading flap opening mechanism which overcomes the problems associated with the above-mentioned designs is disclosed in U.S. Pat. No. 4,191,005 entitled "Case Opening Apparatus", issued Mar. 4, 1980 to Adam Vinoskey and assigned to the assignee hereof. As described in that patent, the leading flap opening mechanism includes a carriage mounted for movement along a track which is situated above and extends in a direction generally parallel to a case conveyor. When the case reaches a predetermined location along the conveyor, conveyor movement is temporarily terminated and the carriage is moved along the track by a pneumatic cylinder.

Affixed to the side of the track is a rack having a plurality of gear teeth. The gear teeth of a pinion gear, situated on one end of a shaft extending from the carriage, operably engage the teeth of the rack. Thus, the gear is rotated as the carriage is moved along the track.

A flap engaging disc is operably connected to the other end of the shaft and is situated adjacent the top of the case. Movement of the carriage along the track causes the disc to rotate as it is displaced relative to the case. As it moves, the disc engages the leading flap of the case and pivots same to the open position.

The case opening apparatus described in the Vinoskey patent has proven itself to function reliably. It is also simple in design, has a minimum number of moving parts, and does not require any of the complicated timing mechanisms employed in previously known machines of this type.

However, the Vinoskey case opening apparatus is not adapted to be used with cases having widely differing flap sizes, without significant structural modification, because the rotational and translational movements of the flap engaging disc are not operably independent. These movements are not separately adjustable and cannot be controlled individually.

In the Vinoskey apparatus, the size of the pinion gear, which meshes with the rack and is fixed to the shaft upon which the flap engaging disc is mounted, and the length of carriage movement determine the amount of rotation of the flap engaging disc as the carriage is moved along the track. It has been found that when the appropriately sized pinion gear is selected to obtain the proper rotational movement for opening a relatively small flap, this pinion gear will cause the flap engaging disc to rotate too much to open a larger flap, when the carriage moves along the track an equal distance. In the latter case, the flap opening disc stops rotating with the flap engaging opening in the disc situated in the wrong location.

Thus, while the apparatus will operate reliably on cases having one size flap, it cannot function reliably with cases having significantly different size flaps, without structural modification. In order to make the modification, a different size pinion gear is required, which, in turn, necessitates a change in the spacing between the axis of the shaft to which the flap opening disc is mounted and the rack. Also, the length of travel of the carriage may have to be adjusted. While such modification is possible, it is difficult to accomplish in the field and, in particular, cannot be made easily by a customer who wishes to convert from one size case to another without significant down time.

It is, therefore, a prime object of the present invention to provide an improved case opening apparatus which operates on the principles disclosed in the above-mentioned Vinoskey patent, but which includes leading flap opening apparatus adapted to accommodate cases having flaps of a variety of different sizes.

It is another object of the present invention to provide an improved case opening apparatus which includes independently operable means for causing rotation and translation of the leading flap engaging element.

It is another object of the present invention to provide an improved case opening apparatus wherein the leading flap opening means includes means for causing rotation and translation of the leading flap engaging element which are independently actuatable and adjustable.

It is a further object of the present invention to provide an improved case opening apparatus which includes leading flap opening apparatus designed to function in conjunction with devices for opening the side and trailing flaps of a case.

In accordance with the present invention, apparatus is provided for opening the flaps of a case. The apparatus includes means for opening the leading flap of the case. The leading flap opening means comprises leading flap engaging means, means for rotating the leading flap engaging means to engage and partially open the flap, and means for moving the flap engaging means relative to the case to fully open the flap. The rotating means and moving means are operably independent.

The moving means preferably comprises means for causing translation of the leading flap engaging means. Means are provided for independently actuating the rotating means and translation means. The rotating means and translation means are independently adjustable.

Means are provided for actuating the translation means in response to a given rotational position of the leading flap engaging means. Preferably, the given rotational position is the final rotational position of the flap engaging means.

The translation means preferably comprises a track, a carriage movably mounted on the track, and means for moving the carriage along the track. Means for actuating the carriage moving means are also provided.

The rotating means is preferably mounted on the carriage. The means for actuating the carriage moving means is controlled by the rotating means.

The rotating means comprises a shaft to which the flap engaging means is mounted and means for rotating the shaft. The shaft rotating means comprises a pneumatic cylinder having an extendible piston rod and means for operably connecting the rod to the shaft. Preferably, the means for actuating the translation means is controlled by the movement of the means connecting the rod to the shaft.

The rotating means and the means for actuating the translation means are preferably mounted on the moving means. More particularly, the rotating means and the means for actuating the translating means are mounted on the carriage.

The apparatus also includes a case conveyor and means for detecting the case on the conveyor in a given position. The detector means is effective, when a case in the given position is detected, to deactuate the conveyor and to actuate the rotating means.

Means, located at the end of the path of movement of the moving means, are provided which are effective when actuated to cause the carriage to return to its initial position. These same means are preferably utilized to reactuate the conveyor. Means are provided for returning the rotating means to its initial position.

The apparatus further comprises means for opening the side flaps and means for opening the trailing flap. The side flap opening means is preferably located upstream of the leading flap engaging means such that the side flaps are open prior to the actuating of the leading flap engaging means.

To these and to such other objects which may hereinafter appear, the present invention relates to an improved case opening apparatus, as described in the following specification and set forth in the annexed claims, taken together with the accompanying drawings, wherein like numerals refer to like parts, and in which:

Figure 1:
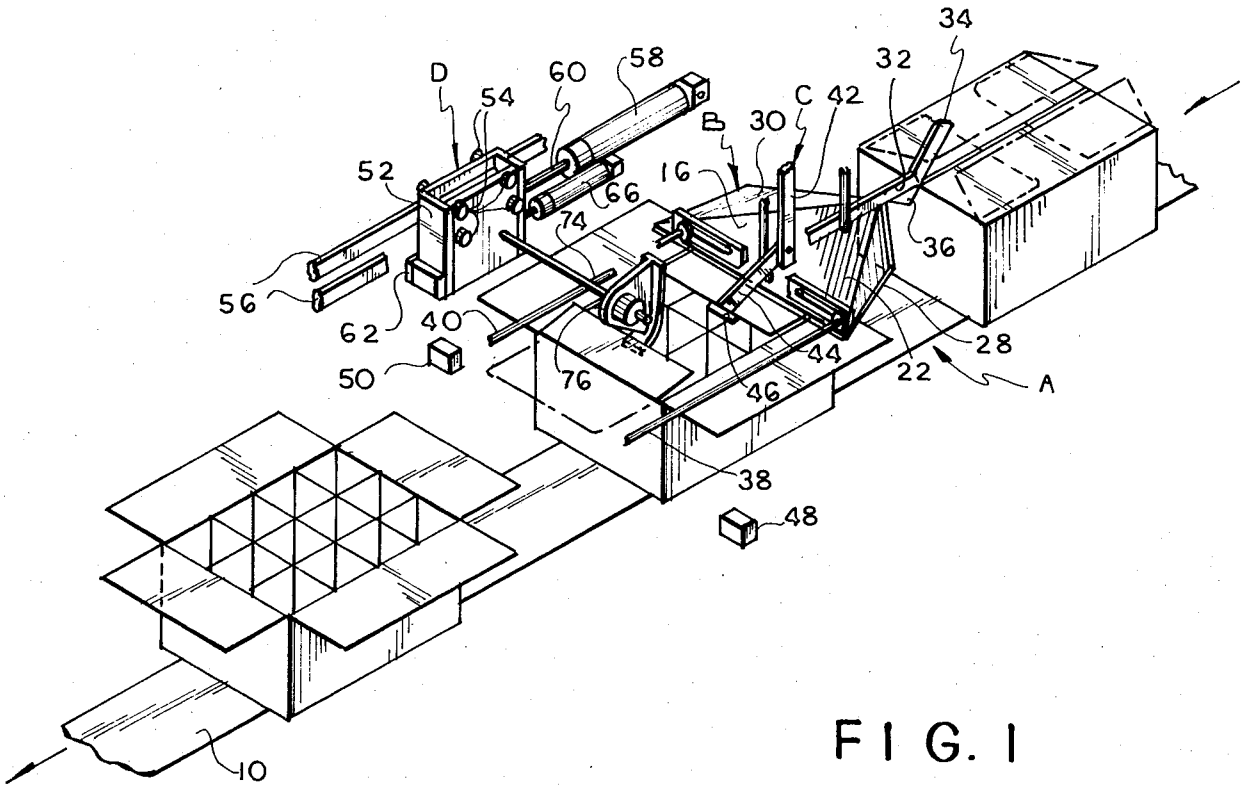
FIG. 1 is an isometric view of a portion of the improved case opening apparatus of the present invention showing cases at three spaced positions on the apparatus.

The improved case opening apparatus of the present invention includes a case conveyor, generally designated A, slide flap opening means, generally designated B, trailing flap opening means, generally designated C, and leading flap opening means, generally designated D. A case, with its flaps closed unsealed, is placed on the input side of conveyor A and is moved along the conveyor (from right to left, as seen in the drawings), such that the side flaps are opened by side flap opening means B. The case continues to move along the conveyor until it aligns with trailing flap opening means C and leading flap opening means D, at which point the movement of conveyor A temporarily ceases. The case remains in this position until the leading flap has been opened by leading flap opening means D. After the leading flap has been opened, conveyor movement is resumed and the trailing flap opening means C opens the trailing flap. The case, with all flaps opened, is then transported to the output side of conveyor A.

Conveyor A may be any conventional case conveyor, a variety of different forms of which are known. In the drawings, case conveyor A is shown as a surface 10, which supports the bottom of the cases, and a pair of endless belts 12 and 14 located on either side of surface 10. Belts 12 and 14 are situated to frictionally engage the opposite sides of a case and move the case through the apparatus of the present invention, as the case is operated on by the various flap opening means.

As the case is moved along conveyor A, it is first acted upon by side flap opening means B. Side flap opening means B comprises a plow 16 mounted above conveyor surface 10 on a pair of transverse support members 18, 20 which extend above and across conveyor A. Plow 16 comprises a substantially triangular planar body section 22, situated in a plane generally parallel to conveyor surface 10, at a height above conveyor surface 10 approximately equal to the height of the case. Section 22 is suspended from support members 18, 20 by bolts 24, 26, respectively, which permit the height of plow 16 to be adjusted with respect to conveyor surface 10.

Extending upwardly and outwardly from each of the upstream facing sides of section 22 is a wing portion 28, 30, respectively. Extending forwardly along the center line of section 22 is an upstanding member 32 to which an upwardly and forwardly inclined plow guide 34 is mounted. Immediately behind plow guide 34 are a pair of outwardly and upwardly extending triangular sections which form a flap deflector 36. Plow 16 is preferably formed from a single piece of sheet metal or similar material.

As the case is moved by case conveyor A, beneath plow 16, plow guide 34 is inserted between the closed side flaps, such that deflector 36 is positioned below the leading edges of the side flaps. As the case continues to move along the conveyor, upwardly inclined wings 28, 30 are inserted beneath the side flaps and the flaps are gradually pivoted outwardly until the side flaps are in a substantially horizontal position, as shown by the middle case in FIG. 1. A pair of side flap hold-down bars 38, 40 extend rearwardly from plow 16 to hold the side flaps in the open position as the leading and trailing flaps are open.

As the case reaches the middle position shown in FIG. 1, the trailing flap is engaged by trailing flap opening means C. Trailing flap opening means C comprises a vertical support 42 to which a trailing flap hook 44 is pivotally mounted. Hook 44 has a position adjustable block 46 on the end thereof positioned to engage the edge of trailing flap.

In this position, the forward wall of the case is aligned with a position detector, shown as a light source 48 and a photoelectric signal generating means 50, located on opposite sides of conveyor surface 10. When the light beam from source 48 to photoelectric generating means 50 is broken by the leading wall of the case, the movement of conveyor A is temporarily terminated and the operation of the leading flap opening means is initiated.

Leading flap opening means D includes a carriage 52 movably mounted by rollers 54 on a pair of parallel tracks 56. Tracks 56 are situated above and to one side of conveyor A and extend in a direction generally parallel to the conveyor.

Carriage 52 is moved along tracks 56 by a pneumatic cylinder 58 connected to the carriage by piston rod 60. The length of the path of movement of carriage 52 along tracks 56 may be adjusted by altering the effective length of the stroke of cylinder 58. The actuation of pneumatic cylinder 58 is controlled by a switch 62 mounted on carriage 52.

Also mounted on carriage 52, by a bracket 64, is a second pneumatic cylinder 66. Piston rod 68 of pneumatic cylinder 66 has a clevis 70 mounted to the end thereof. Clevis 70, in turn, is pivotally connected to a pivot arm 72. Pivot arm 72 is, in turn, fixedly mounted to one end of a shaft 74. Shaft 74 is mounted on carriage 52 and extends over the center line of conveyor surface 10. Fixedly mounted to the other end of shaft 74 is the leading flap engaging element 76. Cylinder 66 causes rotation of shaft 74 and, thus, element 76. The degree of rotation imparted to element 76 may be adjusted by altering the effective length of the stroke of cylinder 66.

Element 76 includes a vertical part 78, the upper portion of which is mounted on shaft 74, and a lower part 80 which is mounted to the lower edge of part 78. Part 78 has a generally triangular shape with a curved portion 82 which cooperates with the outwardly extending part 80, and particularly tail 84 thereof, to form a generally semicircular leading flap receiving recess. Part 80 extends outwardly from the bottom of part 78 in a direction generally perpendicular thereto.

Figure 4:
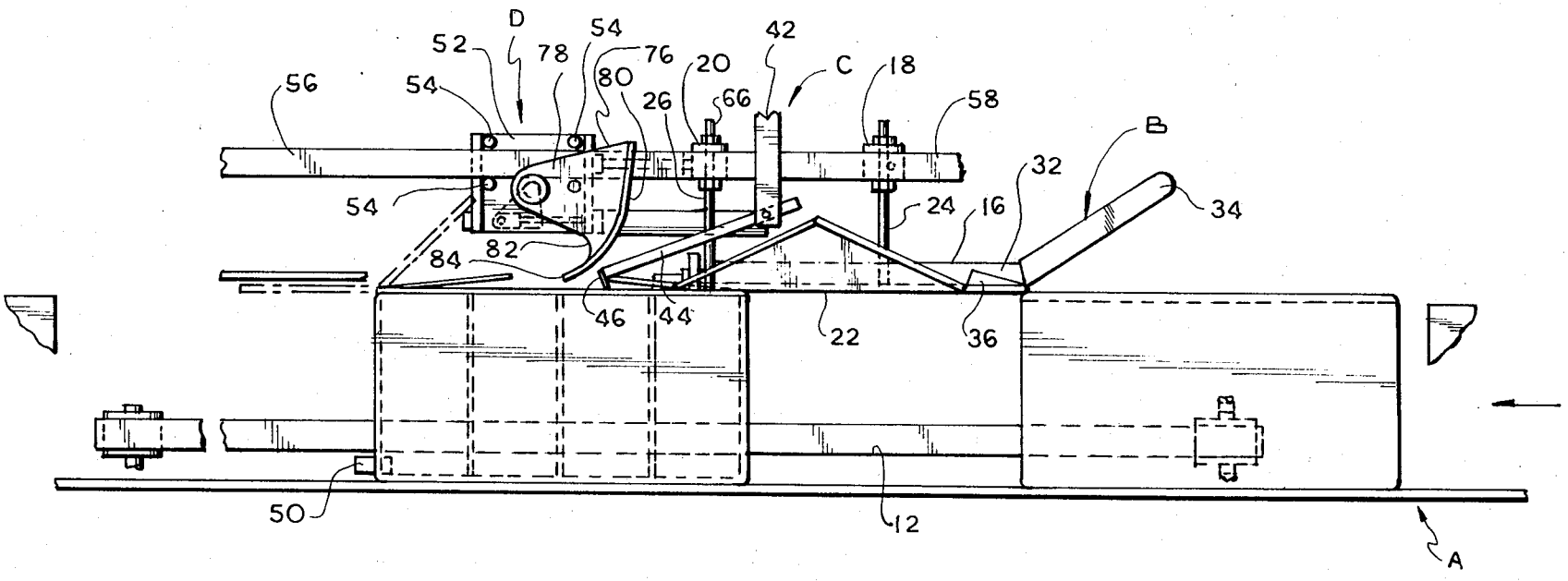
FIG. 4 is a side view of the improved case opening apparatus of the present invention, showing the leading flap engaging element in its initial rotational position.

When a case is positioned on conveyor A so as to be detected by the photoelectric detector 48, 50, the case is correctly positioned with respect to the leading flap opening means D to permit operation thereof. When the detector is actuated, the leading flap engaging element 76 is in its initial rotational position and carriage 52 is in its initial translational position, as shown in FIG. 4. At this point, tail 84 of leading flap opening element 76 is spaced a small distance from the edge of the leading flap.

Photosensitive electronic signal generating means 50, which causes temporary termination of conveyor movement when the case is correctly positioned with respect to the leading flap opening means D, also causes the commencement of the operation of leading flap opening means D by actuating cylinder 66.

Figure 5:
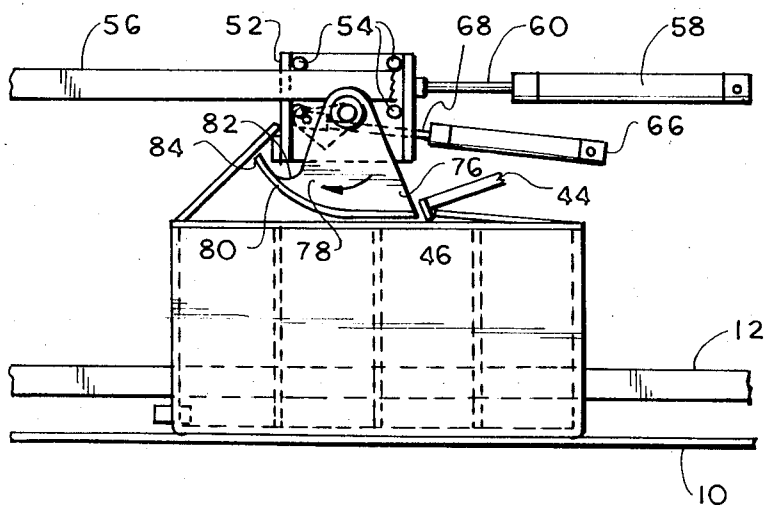
FIG. 5 is a partial side view of the improved case opening apparatus of the present invention showing the leading flap engaging element in its final rotational position.

The actuation of cylinder 66 causes piston rod 68 to extend such that clevis 70 moves pivot arm 72 to rotate shaft 74 and, thus, element 76 from its initial rotational position to its final rotational position through an arc of approximately 120°, as seen in FIG. 5. As this rotational movement occurs, tail 84 of element 76 is inserted beneath the leading flap and the edge of the flap is received in the recess formed between tail 84 and curved portion 82 of element 76. At the end of the rotation of element 76, the leading flap is in a partially opened position, as depicted in FIG. 5, and the tail 84 of the element 76 is approximately $2\frac{1}{2}$ inches above the score line of the case.

Figure 2:
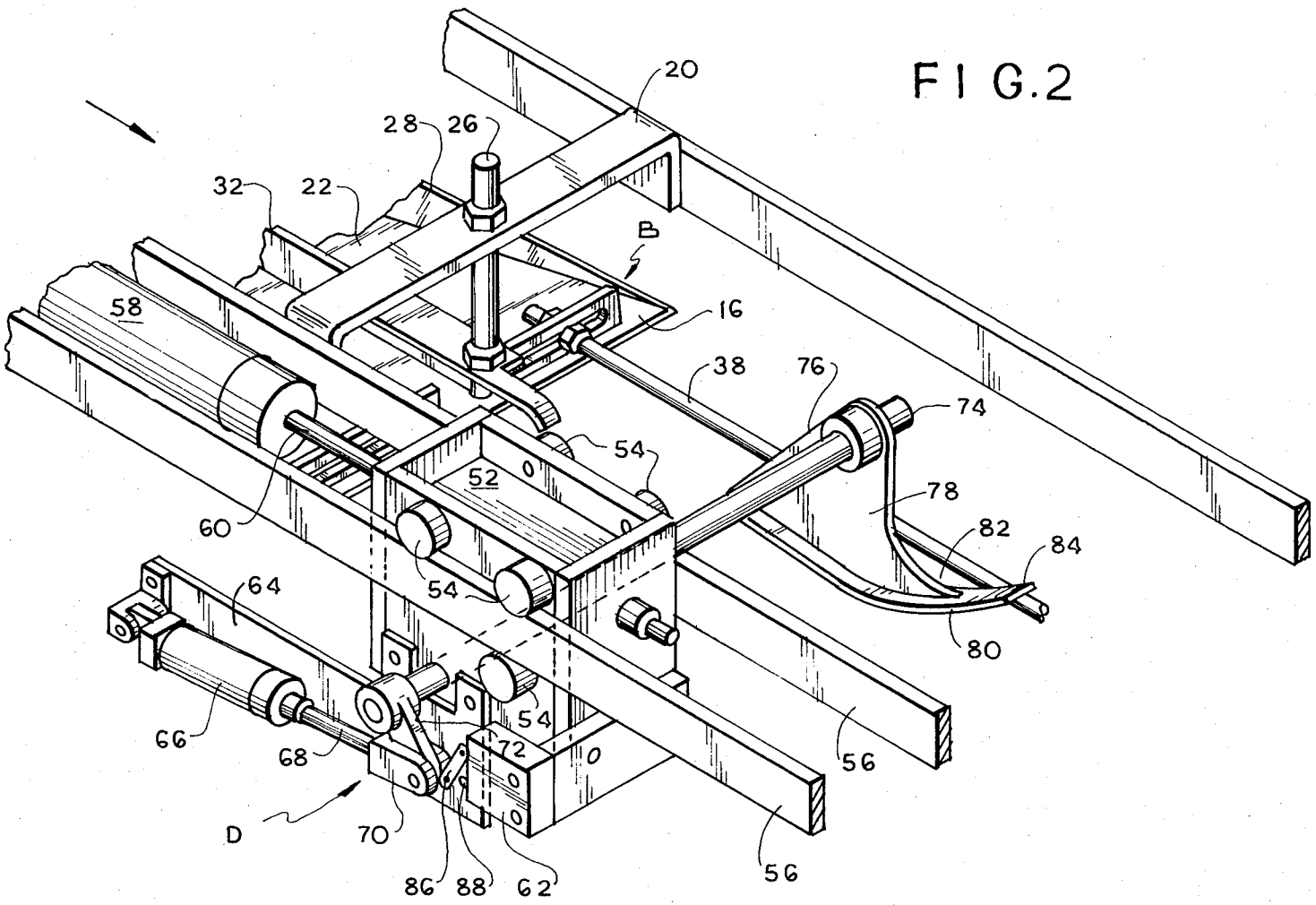
FIG. 2 is an isometric view of the leading flap engaging means of the improved case opening apparatus of the present invention.
Figure 3:
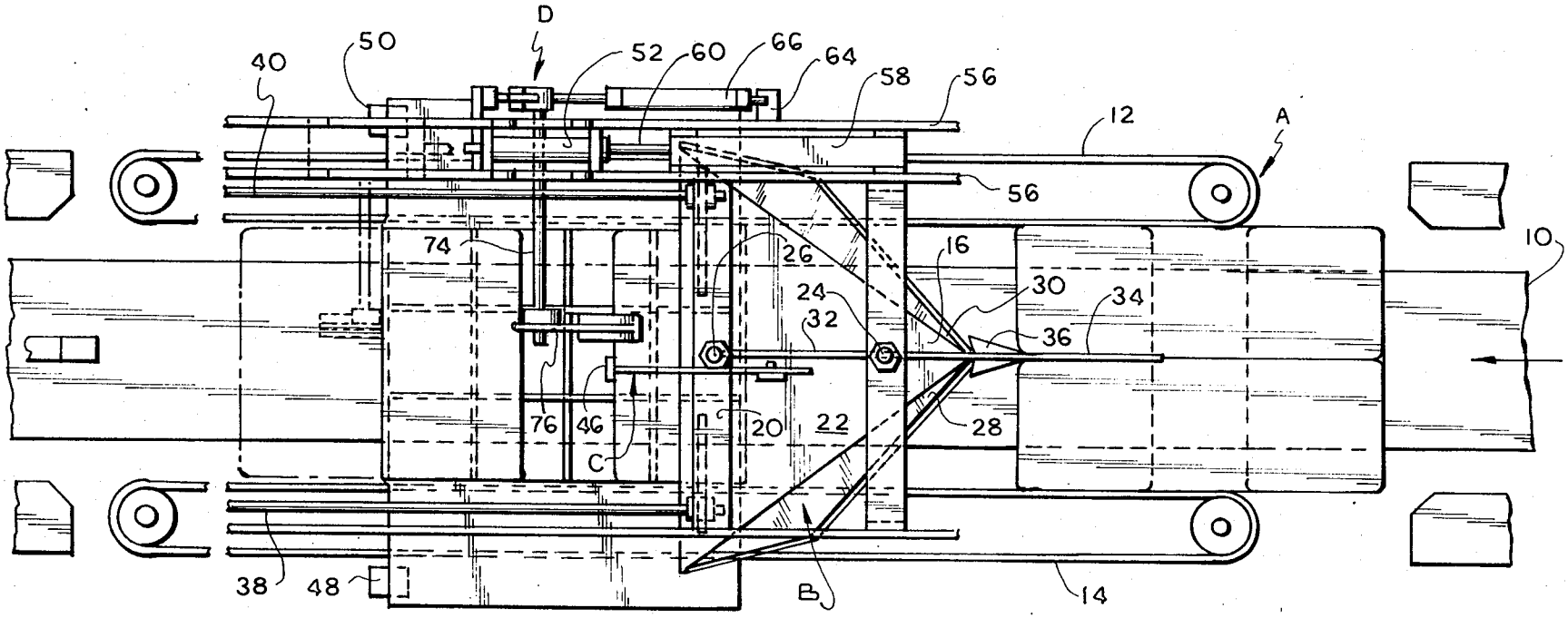
FIG. 3 is a plan view of the improved case opening apparatus of the present invention.

As best seen in FIG. 2, as piston rod 68 approaches its extended position, the tip of clevis 70 pivots an arm 86, the upper end of which is pivotally mounted to carriage 52, to a position where arm 86 depresses the trigger 88 of switch 62. The depression of trigger 88 causes switch 62 to actuate pneumatic cylinder 58.

The actuation of pneumatic cylinder 58 causes piston rod 60 to extend, thereby causing carriage 52 to move downstream with respect to conveyor A, along tracks 56. Carriage 52 moves along tracks 56 approximately 10 inches.

Figure 6:
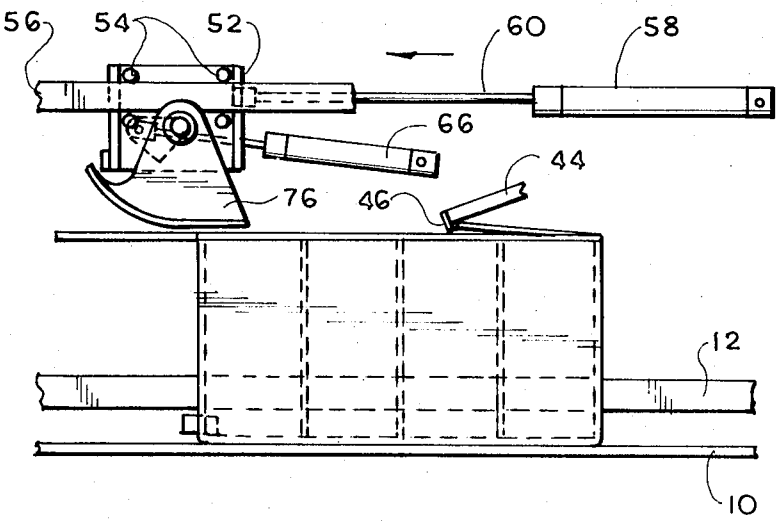
FIG. 6 is a view similar to FIG. 5 showing the leading flap engaging means in its final translational position.

As carriage 52, and thus element 76, are moved linearly with respect to the case, the tail 84 of element 76 causes the leading flap to pivot to its fully opened position, substantially parallel to the top of the case. This is depicted in FIG. 6. When carriage 52 reaches the end of its path of travel along tracks 56, a limit switch (not shown) is tripped. The actuation of the limit switch causes both cylinders 58 and 64 to return to their respective initial conditions, that is, with piston rods retracted, such that carriage 54 returns to its initial position and element 76 returns to its initial rotational position. At the same time, the limit switch causes reactuation of conveyor A such that the case again moves along surface 10.

As shown in FIG. 6, the trailing flap is engaged by hook C and, particularly, block 46 thereof, but remains in the closed position, as leading flap opening means D operates on the case. However, when conveyor movement is reinitiated, the forward movement of the case will cause the hook to pivot the trailing flap to its opened position. As the case continues to move, hook C disengages from the trailing flap and all of the flaps are in the opened position, as illustrated by the last case in FIG. 1.

As will now be appreciated, the rotational and translational movements of element 78 are operably independent in the improved flap opening apparatus of the present invention, such that each movement can be independently actuated and adjusted. This feature, in conjunction with the configuration of element 78, permits the apparatus of the present invention to operate reliably on cases with a wide range of flap sizes, without significant structural modification. Consequently, the improved apparatus of the present invention has increased versatility as compared with conventional devices of this type, resulting in a more commercially viable product.

While only a single preferred embodiment of the present invention has been disclosed herein for purposes of illustration, it is obvious that many modifications and variations could be made thereto. It is intended to cover all of these variations and modifications which fall within the scope of the present invention, as defined by the following claims:

I claim:

1. Apparatus for opening the flaps of a case or the like comprising leading flap engaging means, means for rotating said leading flap engaging means to engage and partially open the leading flap, means for moving said leading flap engaging means relative to said case to fully open the leading flap and means for actuating said rotating means and thereafter actuating said moving means, in sequence.

2. The apparatus of claim 1, wherein said moving means comprises means for causing translation of said leading flap engaging means.

3. The apparatus of claim 2, wherein said translation means comprises a track, a carriage movably mounted on said track, means for moving said carriage along said track and means for actuating said carriage moving means.

4. The apparatus of claim 3, wherein said rotating means is mounted on said carriage.

5. The apparatus of claim 3, wherein said means for actuating said carriage moving means is controlled by said rotating means.

6. The apparatus of claim 3, wherein said means for actuating said carriage moving means is mounted on said carriage.

7. The apparatus of claim 1, wherein said rotating means comprises a shaft to which said leading flap engaging means is mounted and means for rotating said shaft, said shaft rotating means comprising a pneumatic cylinder having an extendible piston rod and means for operably connecting said rod to said shaft.

8. The apparatus of claim 7, further comprising means for actuating said moving means and wherein said means for actuating said moving means is actuated by said connecting means.

9. The apparatus of claim 7, wherein said moving means comprises a track, a carriage movably mounted on said track, means for moving said carriage along said track and means for actuating said carriage moving means.

10. The apparatus of claim 9, wherein said shaft is mounted on said carriage.

11. The apparatus of claim 9, wherein said cylinder is mounted on said carriage.

12. The apparatus of claim 1, further comprising a case conveyor and means for detecting a case on said conveyor means in a given position, said detector means being effective, when a case in said given position is detected, to deactuate said conveyor and activate said rotating means.

13. The apparatus of claim 12, further comprising means located at the end of the path of movement of said moving means which are effective when actuated to cause said moving means to return to its initial position and to reactuate said conveyor.

14. The apparatus of claim 12, further comprising means for returning said rotating means to its initial position.

15. The apparatus of claim 12, further comprising means for opening the side flaps and means for opening the trailing flap.

16. Apparatus for opening the flaps of a case or the like comprising leading flap engaging means, means for rotating said leading flap engaging means to engage and partially open the leading flap, means for moving said leading flap engaging means relative to the case to fully open the leading flap, said rotating means and said moving means being operably independent, said moving means comprising means for causing translation of said leading flap engaging means and further comprising means for actuating said translation causing means in response to a given rotational position of said leading flap engaging means.

17. The apparatus of claim 16, wherein said given rotational position is the final rotational position of said leading flap engaging means.

18. Apparatus for opening the flaps of a case or the like comprising a case conveyor, means adapted to engage and open the side flaps of the case, as the case is moved along said conveyor, means, located downstream of said side flap opening means, for detecting the presence of a case, leading flap engaging means, means for rotating said leading flap engaging means to engage and partially open the leading flap, means for causing translation of said leading flap engaging means relative to the case to fully open the leading flap, means for actuating said translation means in response to a given rotational position of said flap engaging means, said detecting means being effective, when the presence of a case is detected, to deactuate said conveyor and actuate said rotating means.

19. The apparatus of claim 18, wherein said given rotational position is the final rotational position of said leading flap engaging means.

20. The apparatus of claim 18, wherein said translation means comprises a track situated above and extending in substantially the same direction as said conveyor, a carriage movably mounted on said track, means for moving said carriage along said track and means for actuating said carriage moving means.

21. The apparatus of claim 20, wherein said rotating means is mounted on said carriage.

22. The apparatus of claim 20, wherein said means for actuating said carriage moving means is actuated by said rotating means.

23. The apparatus of claim 18, wherein said rotating means comprises a shaft to which said flap engaging means is mounted and means for rotating said shaft, said shaft rotating means comprising a pneumatic cylinder having an extendible piston rod and means for operably connecting said rod to said shaft.

24. The apparatus of claim 23, further comprising means for actuating said translation means and wherein said means for actuating said translation means is actuated by said connecting means.

25. The apparatus of claim 24, wherein said rotating means and said means for actuating said translation means are mounted on said translation means.

26. The apparatus of claim 23, wherein said translation means comprises a track situated above and extending in substantially the same direction as said conveyor, a carriage movably mounted on said track, means for moving said carriage along said track and means for actuating said carriage moving means.

27. The apparatus of claim 26, further comprising means located at the end of the path of movement of said carriage which are effective when actuated to cause said carriage to return to its initial position and to reactuate said conveyor.

28. The apparatus of claim 26, further comprising means for returning said rotating means to its initial position.

* * * * *